US008186764B2

(12) United States Patent
Johnson et al.

(10) Patent No.: US 8,186,764 B2
(45) Date of Patent: May 29, 2012

(54) NOISE REDUCED CONTINUOUS MINER

(75) Inventors: Randall F. Johnson, Franklin, PA (US); Joseph J. Zimmerman, Franklin, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 398 days.

(21) Appl. No.: 12/433,362

(22) Filed: Apr. 30, 2009

(65) Prior Publication Data

US 2010/0276985 A1 Nov. 4, 2010

(51) Int. Cl.
*E21C 35/20* (2006.01)

(52) U.S. Cl. ..... 299/64

(58) Field of Classification Search ..... 299/64, 299/55, 56, 95; 166/75.11, 77.51; 198/813
See application file for complete search history.

(56) References Cited

U.S. PATENT DOCUMENTS 3,516,712 A 6/1970 Bennett et al.
4,090,601 A * 5/1978 Freed, Jr. ..... 198/316.1
7,814,971 B2 * 10/2010 Jones ..... 166/75.11
* cited by examiner

*Primary Examiner* — John Kreck
(74) *Attorney, Agent, or Firm* — Michael Best & Friedrich LLP

(57) ABSTRACT

A mining machine comprising a discharge boom including a tail slide plate slidably connected between left and rear side frames, and a tail roller assembly mounted on the tail slide plate. The tail roller assembly includes a take-up roller mounted centrally between the side frames and between a pair of spacer blocks and a pair of bearing blocks, each of the spacer blocks and bearing blocks being connected to a rearward edge of the tail slide plate. The mining machine also has an opening in each of the side frames, and two slide plate guides, one on each side frame, each of which is positioned outside of the respective side frame adjacent a respective one of the side frame openings, and mounted for sliding movement relative to its respective side frame. The tail slide plate has opposed outside edges received within a respective one of the slide plate guides, and a pair of take up cylinders, one on each side frame, each of which is connected to and extending between the respective side frame and the end of the slide plate guide. The tail roller assembly also includes a pliable elastomer and/or wear material sandwiched between the inside of each of the tail slide plate guides and the outside of each of the side plates, and a polymer-based cushion is connected between the end of the cylinder and the boom side frame.

10 Claims, 11 Drawing Sheets

NOISE REDUCED CONTINUOUS MINER

BACKGROUND

This disclosure relates to a continuous miner, and, more particularly, to a discharge boom of a continuous miner.

A variety of methods exist for mining coal and other materials from underground seams. One apparatus that is commonly employed in underground mining operations comprises a continuous mining machine that includes a rotatable cutting drum that is mounted on the front end of the mining machine. As the mining machine is advanced into the seam, the cutting drum dislodges or "wins" the coal from the seam. In some continuous miners of this type, the won material is conveyed rearwardly of the cutter drum by a longitudinally extending conveyor that may discharge into shuttle cars or other mobile conveying apparatuses to transport the won material from the mine face. The continuous mining machine continuously advances into the seam and, as the material is won there from, an entry or tunnel is formed in the seam.

More particularly, as shown in FIGS. 1 and 2 from US Bennett et al U.S. Pat. No. 3,516,712, a continuous miner is supported on endless traction treads 11 and 12, which are at opposite sides thereof, on which the machine is propelled. At the forward end of the mining machine 10 there is a rotary mining head 13, on a transverse axis, to be advanced or sumped into the mine face 14. The mining head 13 is supported on the forward end of a boom 15 by which it may be raised to the roof 16, sumped into the material of the mine face 14, and traversed through the material downwardly to the floor 17. The mining head 13 extends transversely between the opposite ribs 18, 19, and the latter define the side boundaries of the face area that is mined by the mining head 13.

The mining head 13 is supported on the boom 15 at the forward end of the mining machine 10, for rotation of the mining head 13 about its transversely disposed axis. The boom 15 is connected to a mining machine main frame 20 on transverse pivots 21, 22 on which the boom 15 is swung upwardly and downwardly by cylinders 23, 24, connected between the main frame 20 and the boom 15.

Motors 25, 26, power the mining machine 10 on opposite sides of the boom 15. Driving connections 27, 28 extend forwardly from motors 25, 26, respectively, to transmissions 29, 30, at opposite sides of the boom 15, from which the mining head 13 is driven. The motors 25, 26 also provide power for driving traction treads 11, 12. Drive connections 31, 32 extend rearwardly from motors 25, 26, respectively, to transmissions 33, 34 at opposite sides of the main frame 20 for delivering the drive to the traction treads 11, 12.

In the mining operation the material cut and broken out of the mine face 14 falls to the floor 17. There is a gathering head 35 at the front of the mining machine 10, below the boom 15. The gathering head 35 has an apron or deck 36 with its leading edge at the floor 17. Gathering arms 37, 38 at opposite sides of the gathering head 35 operate with an oscillating motion to reach down and to sweep the material into a conveyor 39 that extends longitudinally through the mining machine 10 from the gathering head 35 to a discharge boom 40 at the rear end of the mining machine 10. The conveyor 39 moves the mined material from the forward end of mining machine 10 to its rear end at which it is discharged to conveying apparatus for removing the mined material from the mining place.

The motors 25, 26, power the gathering arms 37, 38. Driving connections 41, 42 extend forwardly from transmissions 33, 34, respectively, to gathering head transmissions 43, 44, from which the gathering arms 37, 38 are driven.

Underground mining utilizes steel-flight conveyor chains to move the mined material along the conveyor 39 from the cutting-end of the continuous miner to a tail or rear end of the discharge boom 40. These conveyor chains move at high speed and ride in steel fabricated troughs. The conveyor chain "flights" engage the mined material and slide it along within these troughs until it reaches the tail end of the conveyor where it is discharged.

One of the highest noise-generating areas of a continuous miner is in the pivoting boom 40 of the machine 10. Here, there are multiple location where conveyor chain "impacts" occur at the tail roller, take-up slide plate, take-up mechanism, springs, struts, cam & follower, pivots, flex-boards, etc. The steel conveyor chains sliding on, and passing over, steel joints, rollers, and guides create numerous impact locations that cause very high sound decibel levels.

SUMMARY

One object of this disclosure is to minimize the noise levels from continuous miners by minimizing impact areas, and where practical, having the steel conveyor chain impact polymer based compounds to absorb energies that would otherwise produce high decibels, Another object of this disclosure is to provide a unique tail roller take-up to maintain chain tension/adjustment while eliminating the current "rattle" points. A built-in dampening feature allows take-up movement while eliminating noise-producing vibrations.

Another object of this disclosure is to minimize steel-on-steel impacts, dampen vibrations that do inevitably occur, and to provide "shielding" from unacceptably high noise-generating sources.

Another object of this disclosure is to eliminate all unnecessary protrusions into the path of the chain and adjusted chain transitions to reduce acceleration forces in the chain and to incorporate the use of polymer-based materials instead of steel to reduce noise generated by impacts. This was done by providing a coated and replaceable tail roller shell, and by using polymer flex-board.

This disclosure provides a mining machine comprising a discharge boom including a tail slide plate slidably connected between left and right side frames, and a tail roller assembly mounted on the tail slide plate. The tail roller assembly includes a take-up roller mounted centrally between the side frames and between a pair of spacer blocks and a pair of bearing blocks, each of the spacer blocks and bearing blocks being connected to a rearward edge of the tail slide plate.

The mining machine also has an opening in each of the side frames, and two slide plate guides, one on each side frame, each of which is positioned outside of the respective side frame adjacent a respective one of the side frame openings, and mounted for sliding movement relative to its respective side frame. The tail slide plate has opposed outside edges received within a respective one of the slide plate guides, and a pair of take up cylinders, one on each side frame, each of which is connected to and extending between the respective side frame and the end of the slide plate guide.

The tail roller assembly also includes a pliable elastomer sandwiched between the side frame and each of the slide plate guides, and a polymer-based cushion is connected between the end of the cylinder and the boom side frame. The slide plate guides are rigidly fastened to the tail slide plate. Shims may be added between the slide plate guides and the tail slide plate to gauge the amount of "squeeze" on the elastomer sandwiched between the slide plate guide and the slide frame.

Figure 1:
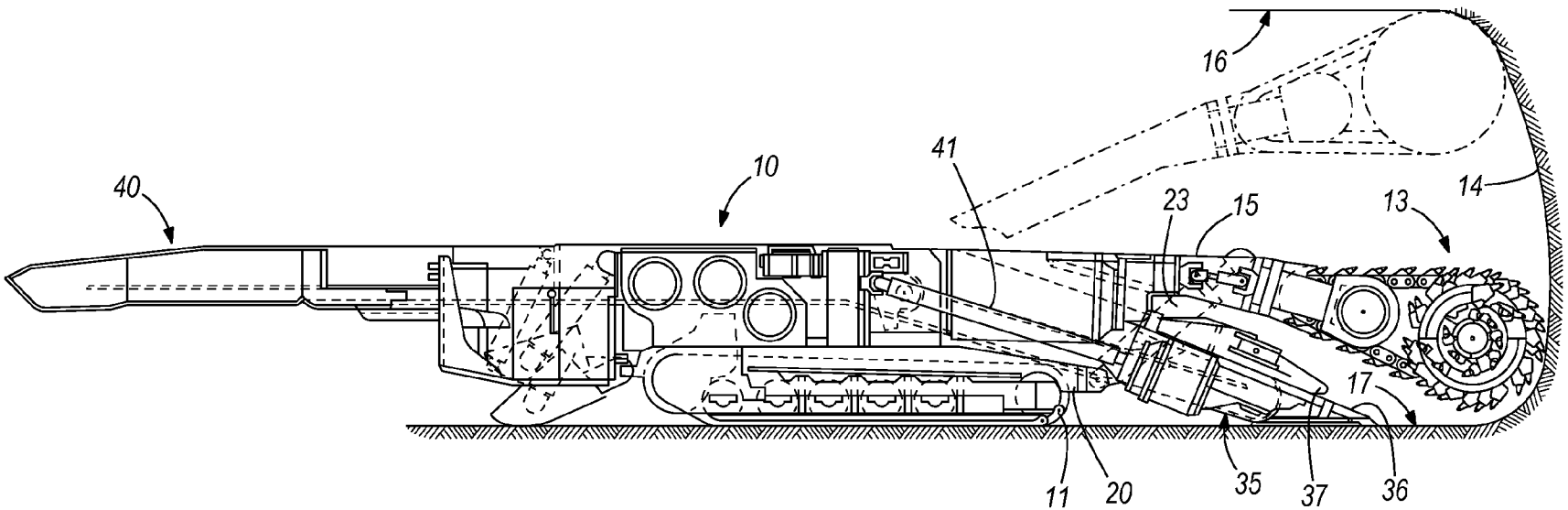
FIG. 1 PRIOR ART
FIG. 1 is a side elevation of a mining machine.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Figure 2:
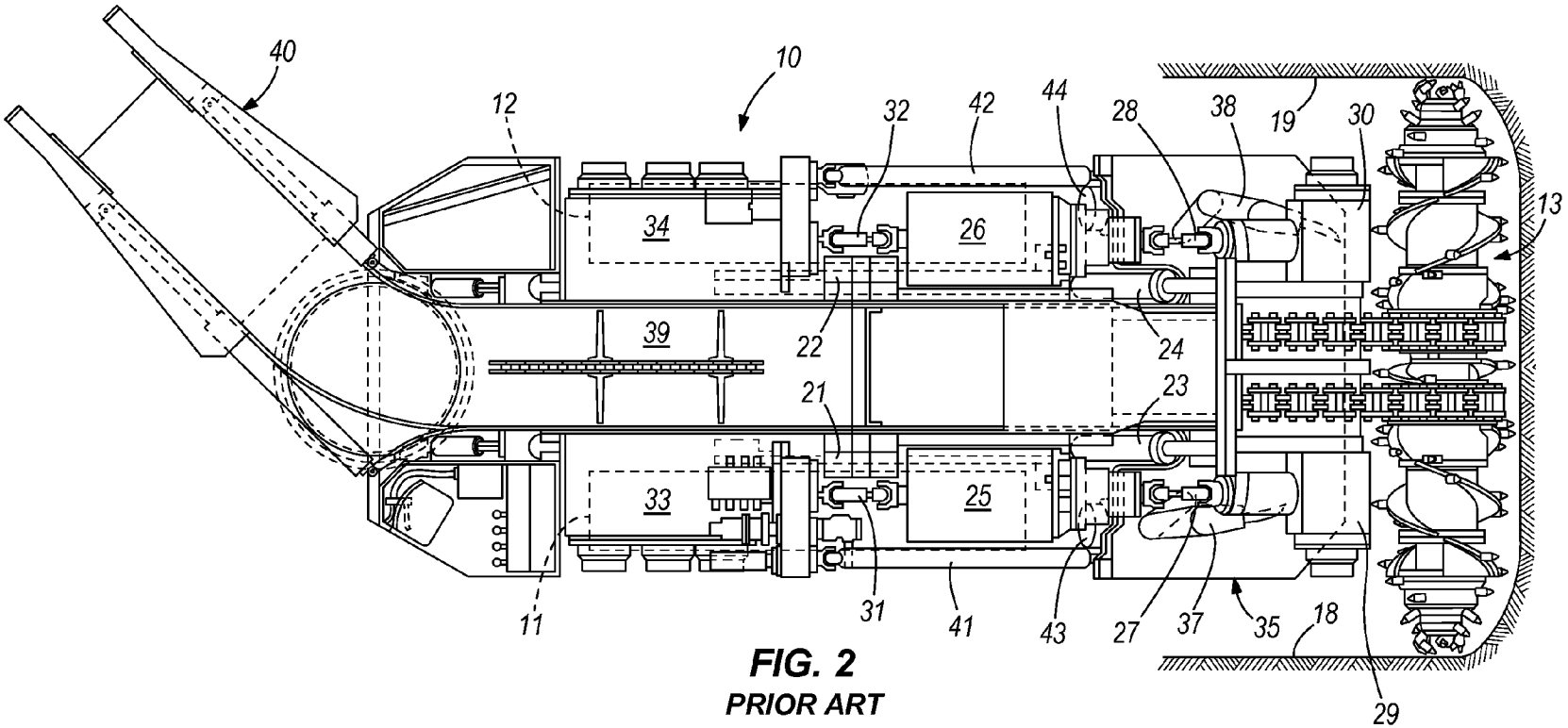
FIG. 2 PRIOR ART
FIG. 2 is a plan view of the mining machine.
Figure 3:
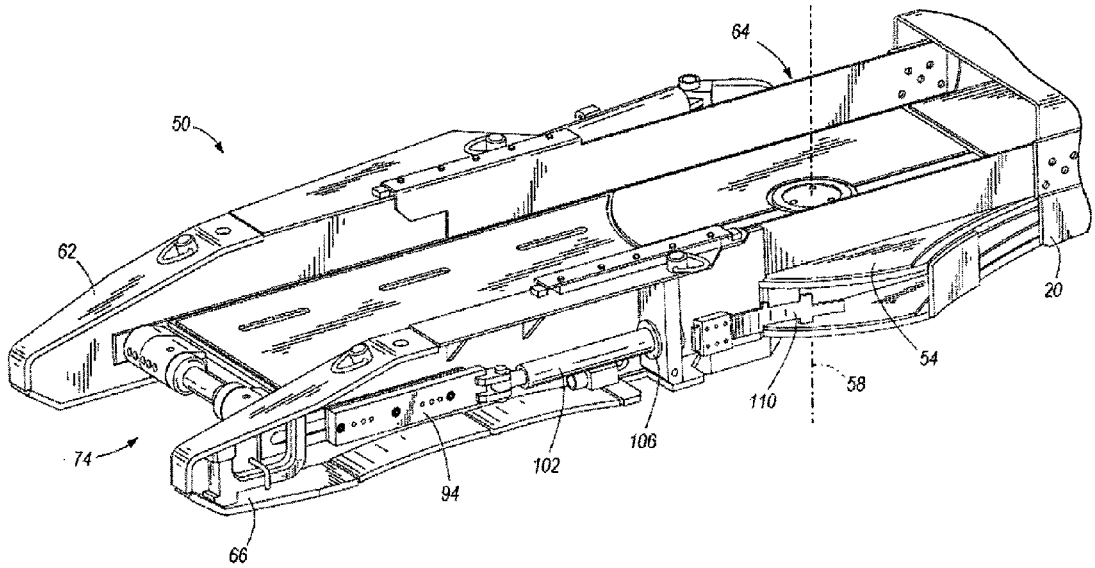
FIG. 3 is a perspective view of a discharge boom, such as that shown in FIGS. 1 and 2.

FIG. 3 is a perspective view of a mining machine including a discharge boom 50, similar to the discharge boom 40 shown in FIGS. 1 and 2. More particularly, this disclosure is directed to reducing noise levels associated with the operation of the discharge boom 50. Elements common to the mining machine 10 of FIGS. 1 and 2 will be referred to as in FIGS. 1 and 2.

As shown in FIG. 3, the pivoting discharge boom 50 is attached to the main chassis or frame 20 at a turntable 54 having a pivot axis 58. The pivoting boom 50 includes left 62 and right 66 side frames attached to the turntable 54. The left and right side frames pivot relative to the main frame 20 about the pivot axis 58. Extending between and attached to each of the left and right side frames and the main frame 20 are flex boards 64. The flex boards 64 keep material within the boom 50 as the boom 50 pivots relative to the main frame 20.

Figure 4:
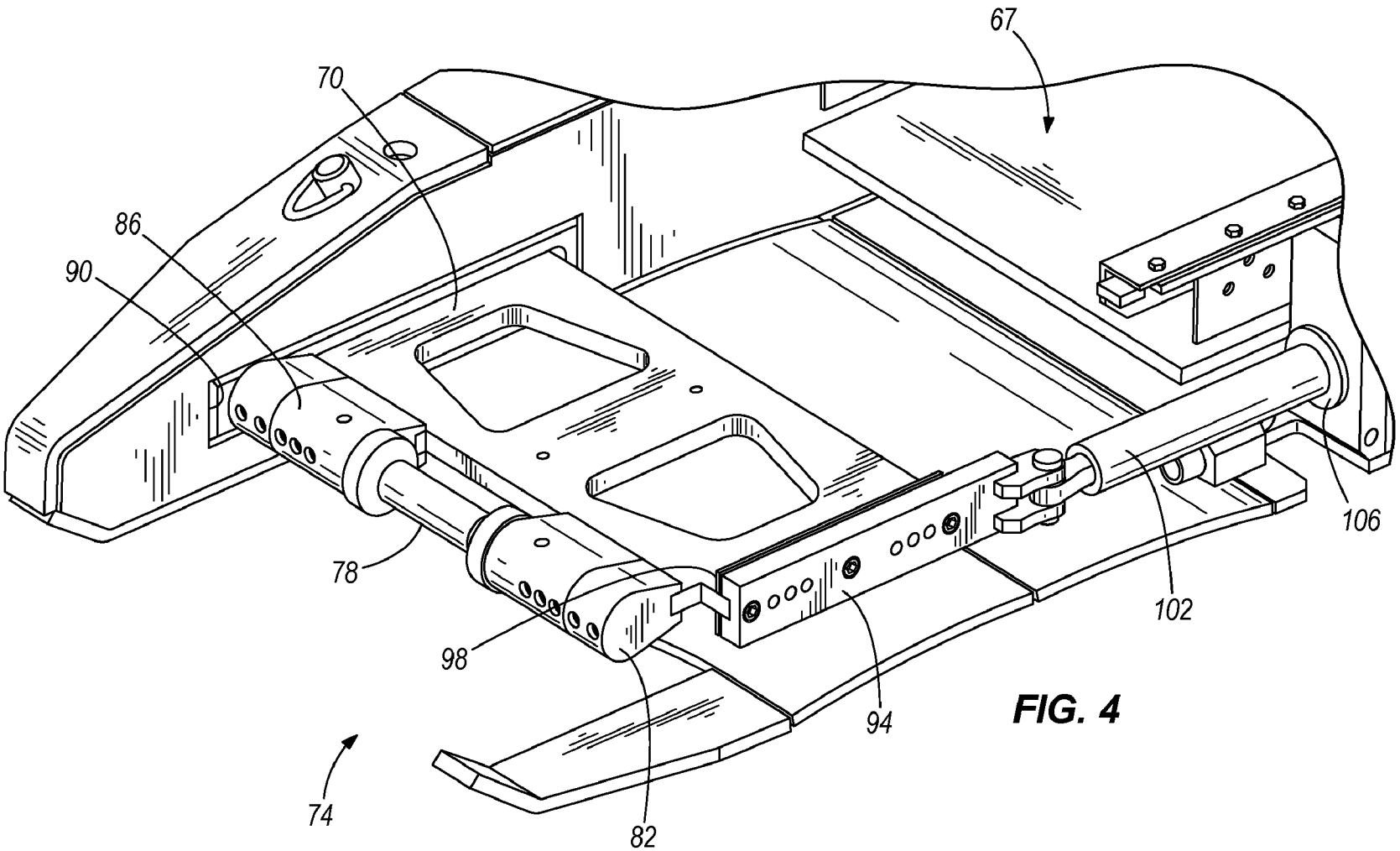
FIG. 4 is an enlarged perspective view of the take-up roller end of the discharge boom shown in FIG. 3.
Figure 5:
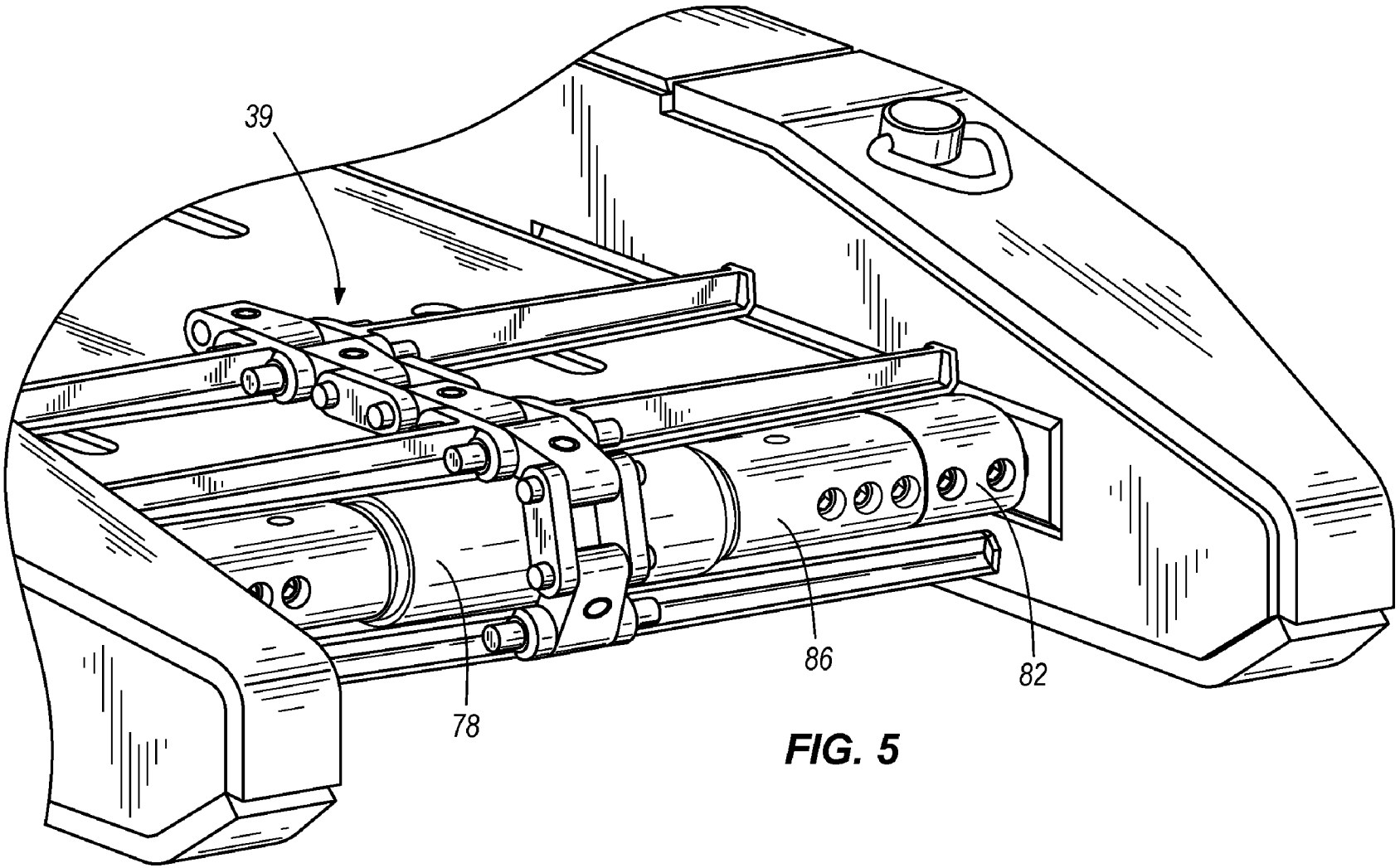
FIG. 5 is a perspective view similar to FIG. 4, with the conveyor shown on the pivot boom.

Also extending between, and attached to each of the left and right side frames is the conveyor decking 67 that forms the bottom of the conveyor trough. In FIG. 4 the tail slide plate 70 is adjacent to the rear of the boom 50. Some of the conveyor decking 67 between the illustrated conveyor decking and the slide plate has been removed for clarity, but would extend over or lap over the slide plate 70.

More particularly, mounted on the rear edge of the tail slide plate 70 at the rear of the boom is the tail roller assembly 74. The conveyor 39 extends longitudinally through the mining machine from the gathering head 35 to and over the tail roller assembly 74. More particularly, the conveyor 39 extends longitudinally through the mining machine from the gathering head 35 to and over the tail roller assembly 74, as shown in FIGS. 5 through 10. The tail roller assembly 74 includes a take-up roller or sprocket 78 mounted centrally between the side frames and between a pair of spacer blocks 82 and a pair of bearing blocks 86. Each of the spacer blocks 82 and bearing blocks 86 is bolted onto the rearward edge of the tail slide plate 70.

Figure 11:
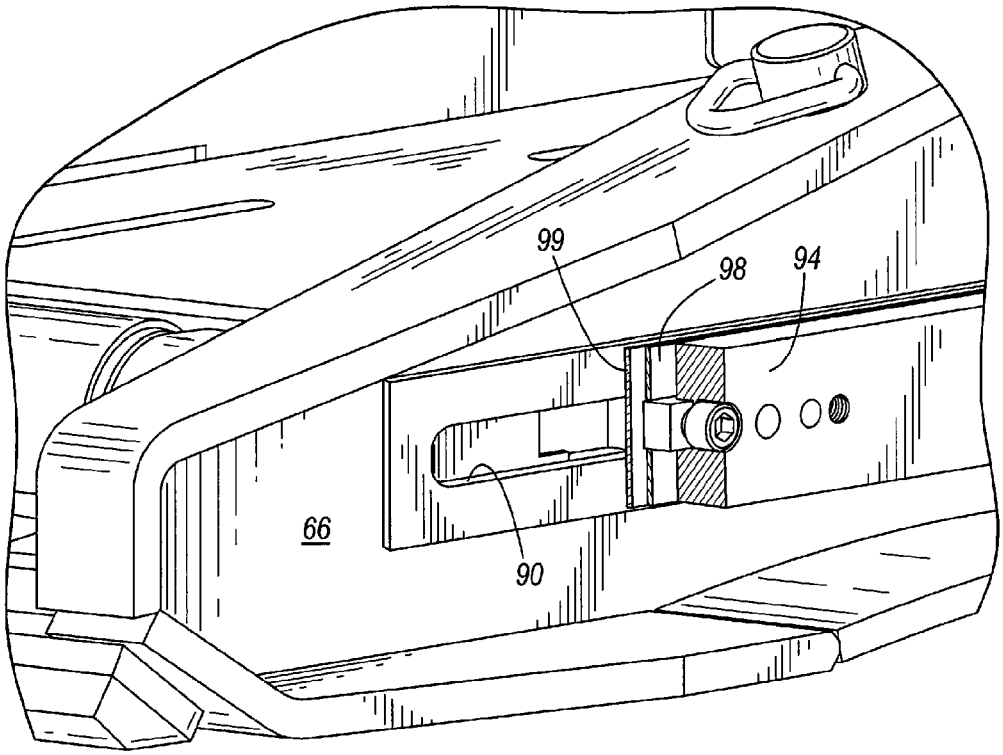
FIG. 11 is an enlarged partial perspective view of the take-up roller end of the discharge boom shown in FIG. 3, showing the sandwiching of wear resistant material and a pliable elastomer between a slide plate guide and a side frame.

As shown in FIG. 3, the tail slide plate 70, and the attached roller assembly 74 are movable relative to the boom left and right side frames 62 and 66. An opening 90 in each of the side frames receives the slide plate 70. Positioned outside of the side frames is a slide plate guide 94. Each of the opposed outside edges of the rear slide plate 70 is received within a respective one of the slide plate guides 94. In order to reduce noise associated with the end of the conveyor 39, the tail slide plate 70 and slide plate guides are isolated from side-to-side movement, as shown in FIG. 11, by the incorporation of a pliable elastomer 98 and wear resistant material 99 that "squeezes" against the outside of the side frame. The frictional forces created here dampen out undue vibrations and noise. Fore and aft movement of the slide plate in openings 90 allows for chain tensioning via take-up cylinders 102. Up and down motion of the slide plate is limited by high tolerancing in the opening 90.

Each of the slide plate guides 94 is mounted for slidable movement relative to its respective side frame. By moving the slide plate guide 94, the tension on the conveyor 39 can be varied. Since the relative length of the boom 50 changes as the boom 50 pivots, it is necessary to move the roller assembly 74 in order to maintain chain tension. Since the roller assembly 74 is attached to the tail slide plate 70, movement of the tail slide plate 70 relative to the boom side frames adjusts the conveyor tension.

In order to move the slide plate guide 94 relative to the side frame, a take up cylinder 102 is connected to and extends between the side frame and an end of the slide plate guide 94. By varying the length of the cylinder 102, the tail slide plate 70 can be moved relative to the side frame. In order to help further isolate tail roller assembly vibration from the remainder of the continuous miner, a polymer-based cushion 106 is connected between the end of the cylinder 102 and the boom side frame.

More particularly, as the tail conveyor swings from left to center to right, the tail roller assembly 74 needs to move about 2½ inches for and aft to keep the conveyor tight. The take-up cylinders 102 have a constant pressure on them to maintain this conveyor tension. Once it is set correctly it doesn't need adjusting. There is a check valve (not shown) in the line so oil can't flow out of the system as excessive force is applied to the tail roller at chain start up. There is also a relief valve (not shown) in this circuit that will relive the "locked-in pressure" if a very high force is applied to the tail roller assembly 74.

Thus, the disclosure provides two areas with vibration dampening characteristics; at the tail roller slide plate 70 and at the forward end of the take-up hydraulic cylinder 102. The tail roller slide plate 70 dampening utilizes a frictional force between the slide plate guide 94 and the discharge boom frame to slow unwanted movement and to dissipate energy. Also, where the take-up cylinder 102 is mounted to the discharge boom frame, the polymer based cushion is utilized to "break the path" of noise going into the conveyor frame.

The disclosure also provides two other locations to provide some measure of noise shielding; one is at the flex-boards 64 and the other is at the chain guide 110 in the return deck at the pivot area. The typical flex-board is made from high strength spring steel and radiates a lot of noise as the conveyor chain impacts it and slides along it. The flex-boards also generate noise on their own due to just "rattling" in place from other machine vibrations. The disclosure incorporates either a flex-board 64 made totally from a polymer based material or having a separate polymer flex-board located to the "outside" of the steel flex-board to shield the noise from where an operator typically stands. A similar design is utilized at the conveyor guide in the return deck at the pivot area.

The roller 78 is mounted in such a way that it can be removed without "breaking" the endless chain or belt of the conveyor 39. More particularly, disassembling the two roller bearing blocks and spacer blocks and sliding the tail roller 78 to either side accomplishes removal of the roller 78.

Figure 6:
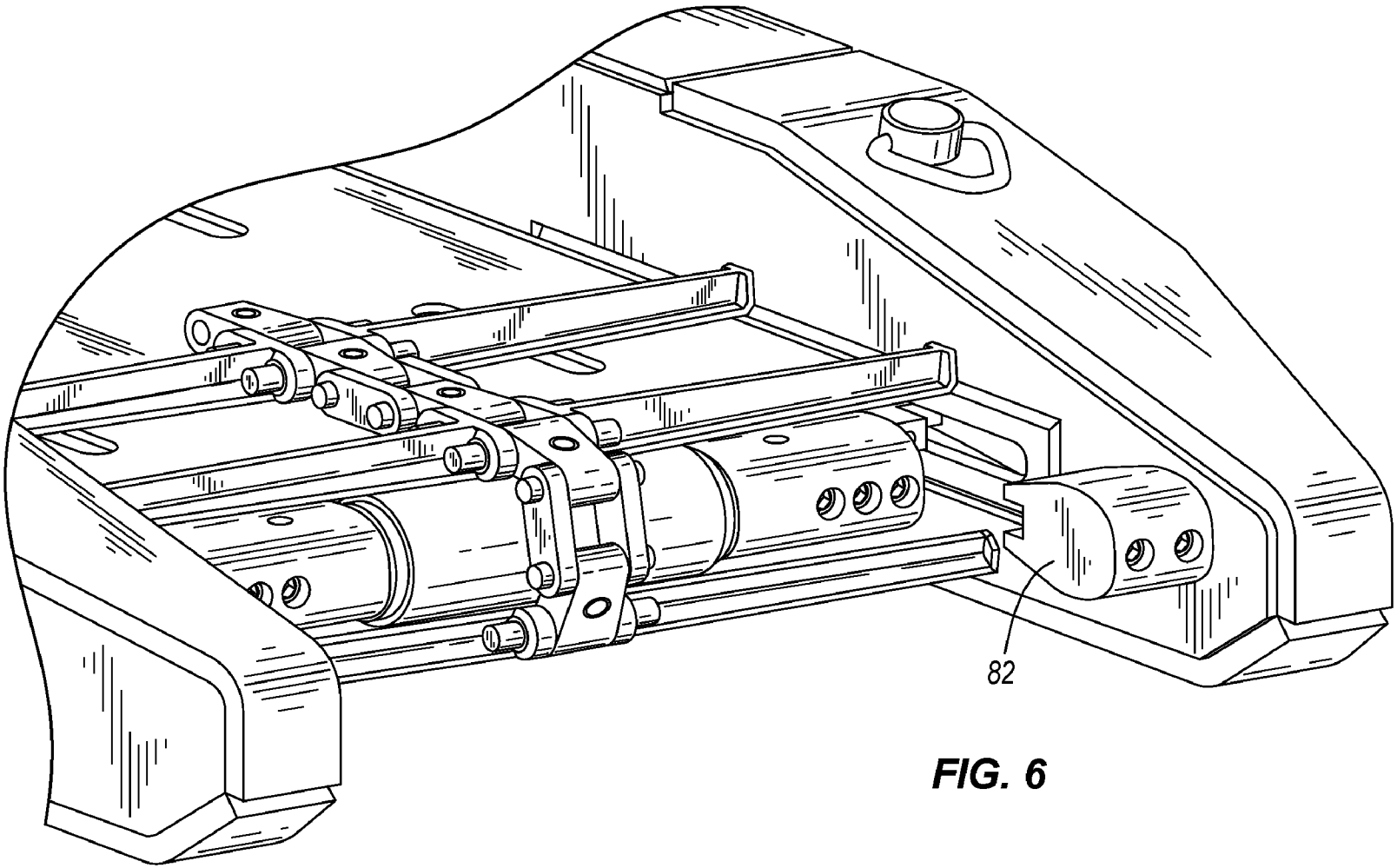
FIG. 6 is a perspective view similar to FIG. 4 illustrating the full roller assembly, with bolts removed from the outside spacer block, and the spacer block removed from its support.
Figure 7:
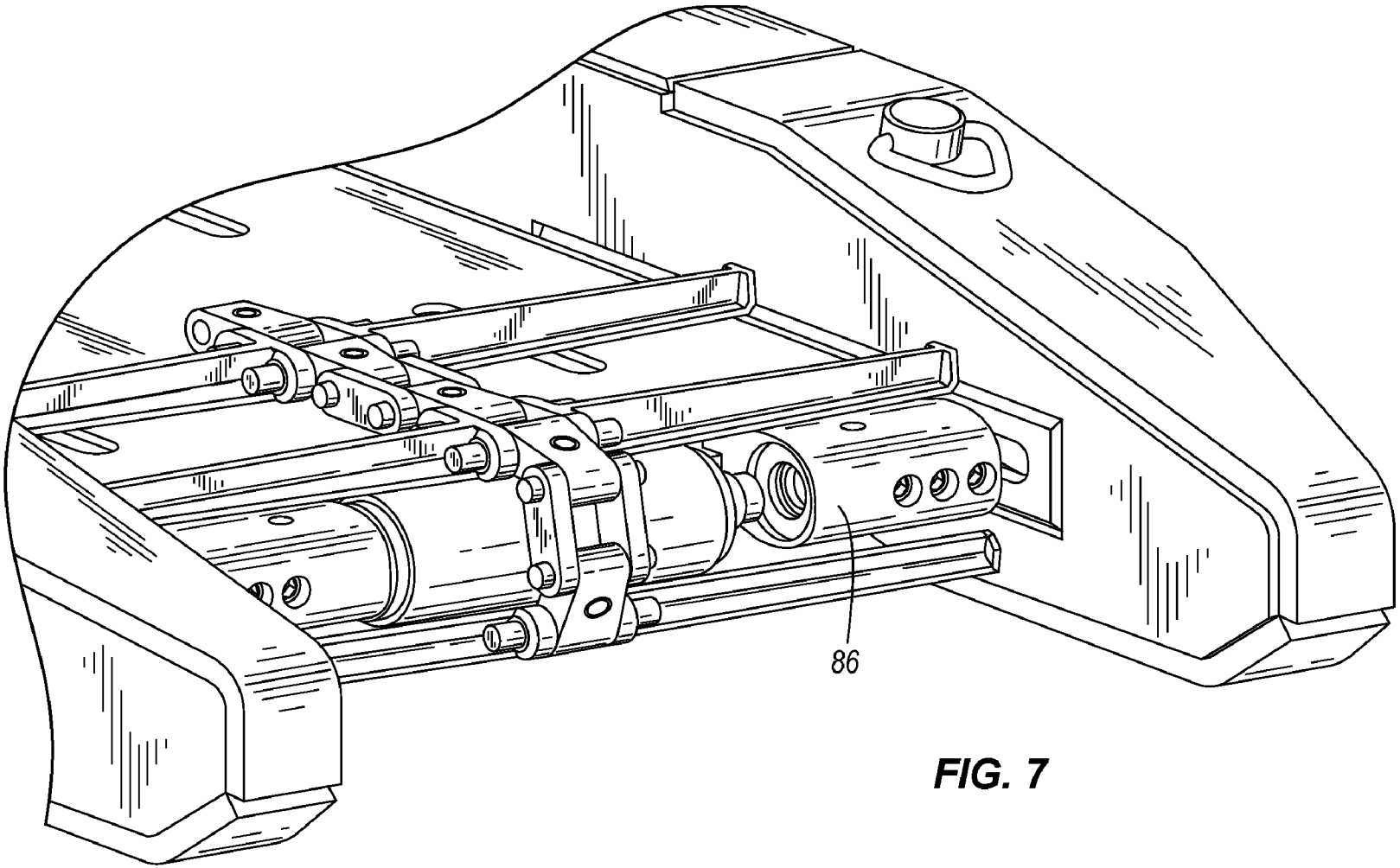
FIG. 7 is a perspective view similar to FIG. 4 illustrating the bolts removed from the bearing block, and the bearing block slid to the right to disengage the bearing block from the roller shaft.
Figure 8:
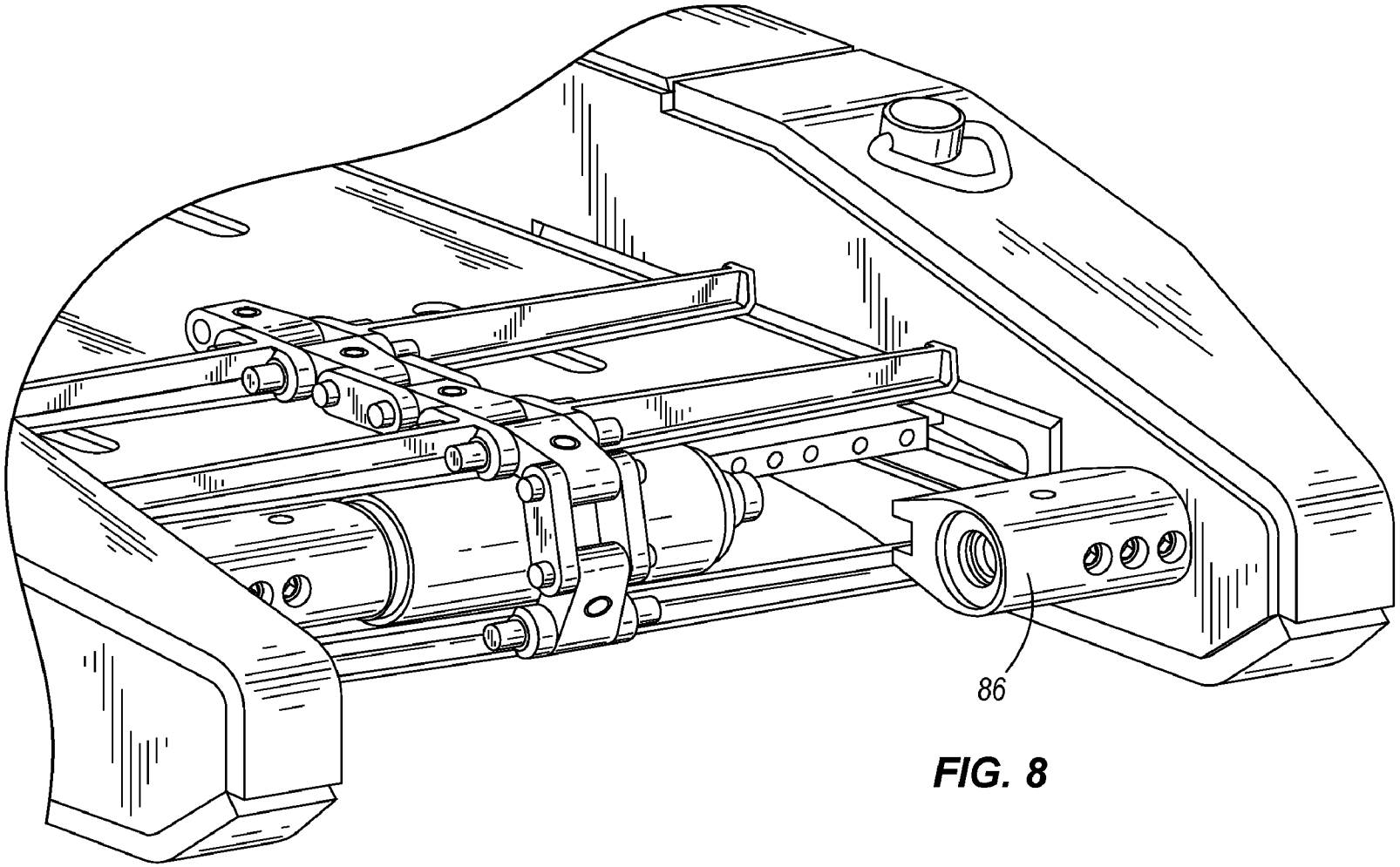
FIG. 8 is a perspective view similar to FIG. 4 showing the bearing block removed from its support.
Figure 9:
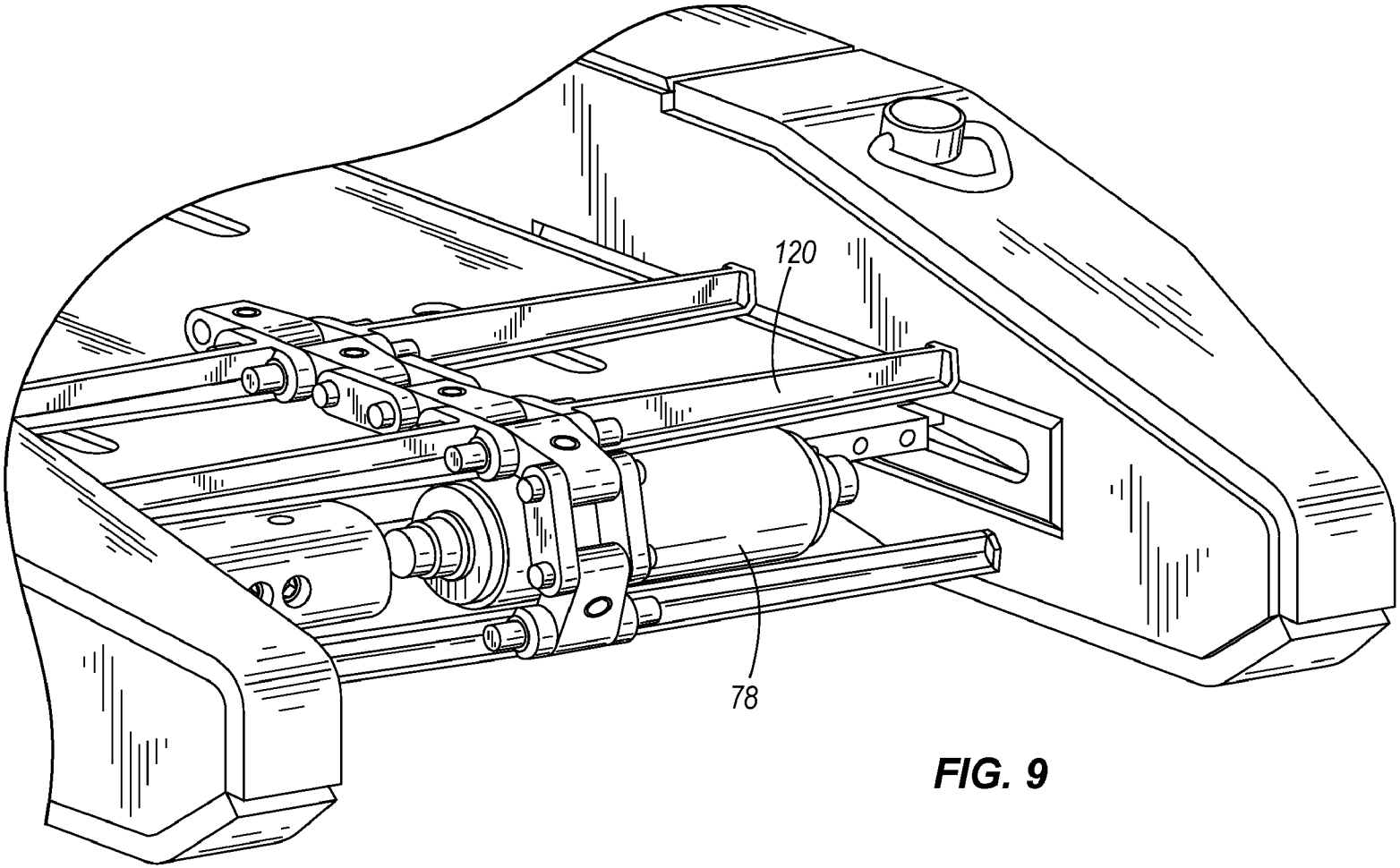
FIG. 9 is a perspective view similar to FIG. 4 showing the roller disengaged from the opposite side bearing block.
Figure 10:
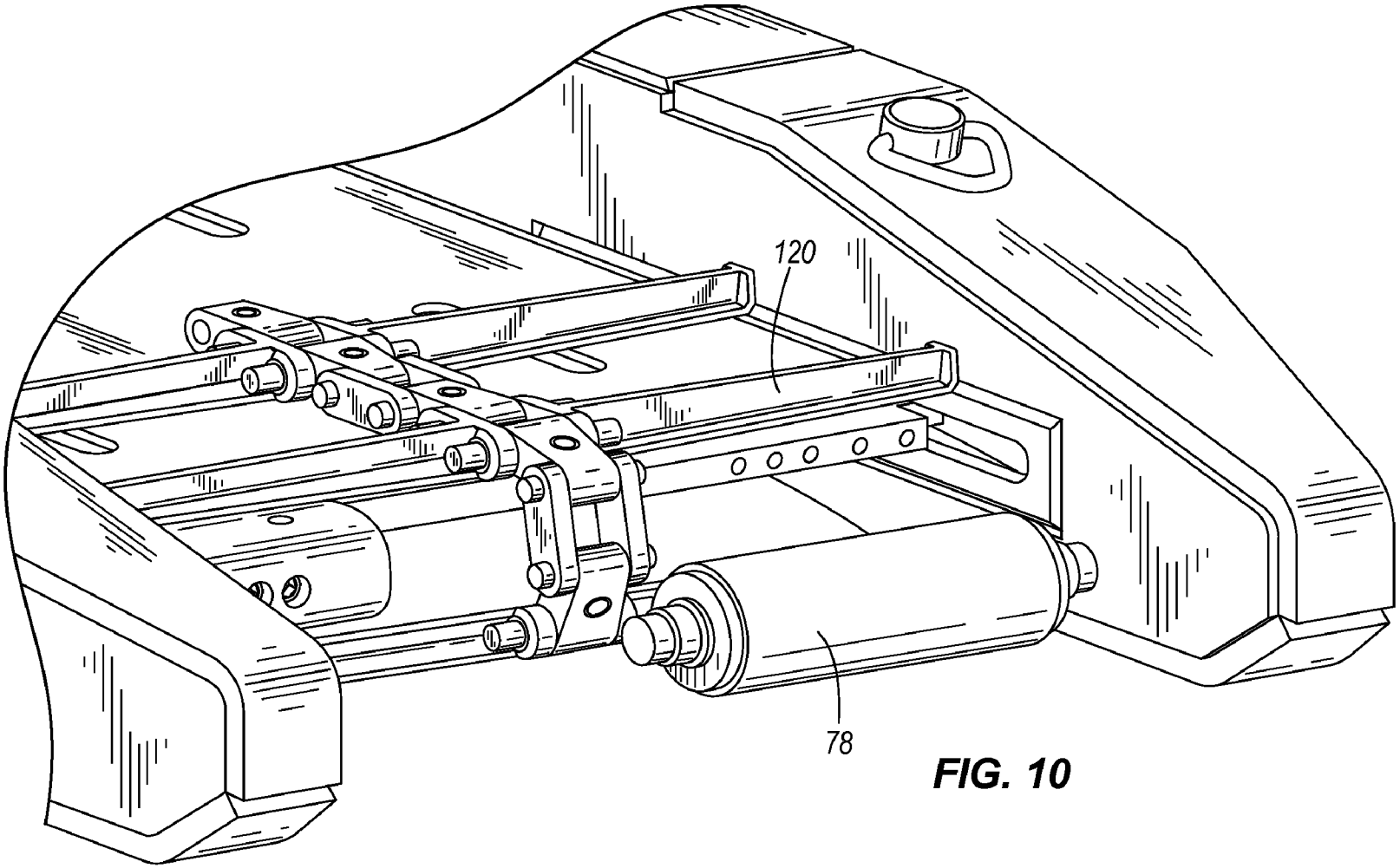
FIG. 10 is a perspective view similar to FIG. 4 showing the roller removed from between the chain flights.

Disassembly of the tail roller assembly 74 begins with the removal of the bolts holding the spacer block 82 to the rear edge of the tail slide plate 70. FIG. 6 illustrates the full roller assembly 74, with the bolts removed from the outside spacer block 82, and the spacer block 82 removed from tail slide plate 70. As shown in FIG. 7, bolts are then removed from the bearing block 86, and the bearing block 86 is slid to the right, as shown in FIG. 7, to disengage the bearing block 86 from the roller shaft. FIG. 8 shows the bearing block 86 removed from tail slide plate 70. As shown in FIG. 9, the roller 78 is then disengaged from the opposite side bearing block 86. And then, as shown in FIG. 10, the roller 78 is moved to the right and out from between the conveyor flights 120. Reassembly of the tail roller assembly 74, with a fresh tail roller, then occurs by reversing this sequence.

This embodiment also has replaced the conventional spring steel flex-boards entirely with a polymer-based material. The challenge here was to develop a material with suitable strength and flexure characteristics to handle the high loads caused by the conveyor chain.

The invention claimed is:

1. A machine defining a longitudinal axis, the machine comprising:

a conveyor extending along the axis, the conveyor defining two sides that are each parallel to the axis;

two side frames, one extending along each side of the conveyor, each side frame including an opening, and each side frame defining an inside surface facing the conveyor and an outside surface opposite to the inside surface;

a tail slide plate extending through at least a part of the openings;

two slide plate guides, one on a respective outside surface of each side frame, each slide plate guide receiving the tail slide plate and slidably movable relative to its respective side frame, wherein each slide plate guide includes a pliable elastomer sandwiched between the slide plate guide and its respective side frame, and each slide plate guide is urged toward its respective side frame; and two take-up cylinders, one on a respective outside surface of each side frame, each take-up cylinder connected to and extending between a respective side frame and slide plate guide.

2. The machine of claim 1 wherein at least one of the slide plate guides includes a wear resistant material sandwiched between the pliable elastomer and its respective side frame.

3. The machine of claim 1 wherein the tail slide plate includes a tail roller assembly mounted thereto, and the conveyor extends over the tail roller assembly.

4. The machine of claim 1 wherein a polymer-based cushion is connected between at least one of the cylinders and its respective side frame.

5. The machine of claim 1, the machine further comprising a shim between at least one of the slide plate guides and the tail slide plate.

6. A mining machine comprising:

a main frame having a forward end and a rear end;

a conveyor extending between the forward end and the rear end, the conveyor defining two sides that are each extending between the forward end and the rear end;

a mining head boom coupled to the forward end of the main frame;

a gathering head coupled to the forward end of the main frame below the mining head boom, the gathering head operable to maneuver material onto the conveyor; and a discharge boom pivotally attached to the rear end of the main frame, wherein the discharge boom includes two side frames, one extending along each side of the conveyor, each side frame including an opening, and each side frame defining an inside surface facing the conveyor and an outside surface opposite to the inside surface, a tail slide plate extending through at least a part of the openings, two slide plate guides, one on a respective outside surface of each side frame; each slide plate guide receiving the tail slide plate and slidably movable relative to its respective side frame, wherein each slide plate guide includes a pliable elastomer sandwiched between the slide plate guide and its respective side frame, and each slide plate guide is urged toward its respective side frame, and two take-up cylinders, one on a respective outside surface of each side frame, each take-up cylinder connected to and extending between a respective side frame and slide plate guide.

7. The mining machine of claim 6 wherein at least one of the slide plate guides includes a wear resistant material sandwiched between the pliable elastomer and its respective side frame.

8. The mining machine of claim 6 wherein the tail slide plate includes a tail roller assembly mounted thereto, and the conveyor extends over the tail roller assembly.

9. The mining machine of claim 6 wherein a polymer-based cushion is connected between at least one of the cylinders and its respective side frame.

10. The mining machine of claim 6, the mining machine further comprising a shim between at least one of the slide plate guides and the tail slide plate.

* * * * *